US009140259B2

(12) United States Patent
Wang

(10) Patent No.: US 9,140,259 B2
(45) Date of Patent: Sep. 22, 2015

(54) FAN-SHAPED ROTOR SET WITH BALANCE POSITIONING APERTURES

(71) Applicant: Yao-Cheng Wang, Luzhu Township, Taoyuan County (TW)

(72) Inventor: Yao-Cheng Wang, Luzhu Township, Taoyuan County (TW)

( * ) Notice: Subject to any disclaimer, the term of this patent is extended or adjusted under 35 U.S.C. 154(b) by 0 days.

(21) Appl. No.: 14/144,550

(22) Filed: Dec. 31, 2013

(65) Prior Publication Data

US 2015/0184653 A1 Jul. 2, 2015

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 2/12*** | (2006.01) |
| ***F04C 15/00*** | (2006.01) |
| ***F04C 18/16*** | (2006.01) |
| ***F04C 29/00*** | (2006.01) |
| ***F04C 18/08*** | (2006.01) |
| ***F04C 2/08*** | (2006.01) |
| ***F04C 2/18*** | (2006.01) |

(52) U.S. Cl.

CPC ..... *F04C 2/126* (2013.01); *F04C 2/084* (2013.01); *F04C 2/18* (2013.01); *F04C 15/0042* (2013.01); *F04C 18/084* (2013.01); *F04C 18/16* (2013.01); *F04C 29/0021* (2013.01); *F04C 2240/20* (2013.01); *F04C 2240/807* (2013.01)

(58) Field of Classification Search

CPC ..... F04C 2/084; F04C 2/18; F04C 2/126; F04C 18/084; F04C 18/126; F04C 18/16; F04C 29/0021; F04C 2240/20; F04C 2240/807; F01C 1/084; F01C 1/126

USPC ..... 418/201.1, 201.3, 206.1, 206.5, 151

See application file for complete search history.

(56) References Cited

U.S. PATENT DOCUMENTS

| | | | | |
|---|---|---|---|---|
| 60,365 | A * | 12/1866 | Hardy | 418/206.5 |
| 178,829 | A * | 6/1876 | Fitts | 418/206.5 |
| 3,302,868 | A * | 2/1967 | Wrede | 418/206.5 |
| 3,799,713 | A * | 3/1974 | Cloots et al. | 418/206.4 |
| 4,453,901 | A * | 6/1984 | Zimmerly | 418/206.1 |
| 7,467,935 | B2 * | 12/2008 | Betz et al. | 418/151 |
| 2012/0285415 | A1 * | 11/2012 | Shehter et al. | 418/206.5 |

* cited by examiner

*Primary Examiner* — Theresa Trieu

(57) ABSTRACT

A rotor set comprises a pair of engaging rotors disposed in a pump room of a housing rotating oppositely with identical speeds. Each rotor comprises a plurality of lobes, and each lobe has a fan-shaped end with a curved edge. The lobe generates an eccentric force to the rotor during the rotation to reduce mechanical consuming energy and save dynamic energy. Therefore, the rotors can achieve strong eccentric torque and self-vacuum effect with low dynamic energy.

4 Claims, 5 Drawing Sheets

FAN-SHAPED ROTOR SET WITH BALANCE POSITIONING APERTURES

BACKGROUND OF THE INVENTION

1. Field of the Invention

The invention relates to a rotor set, and in particular to a pump rotor which providing high efficiency low noise and less vibration.

2. Description of Prior Art

As shown in FIG. 1. A conventional roots rotor set has a pair of engaging rotors 10, and the two rotors 10 are disposed in a pump room 21 defined by a housing 20. The pump room 21 has an inlet 22 at one side and an outlet 23 at another side. The rotor 10 is respectively connected to a transmission shaft 30, and the transmission shaft 30 drives the two rotor 10 in the pump room 21 to make rotation with equal speed in opposite directions.

However, the conventional roots rotor 10 has low efficiency, loud noise and strong vibration due to the design of lobes 11 of the rotor 10.

Therefore, it is desirable to provide a combination of a rotor set to mitigate and/or obviate the aforementioned problems.

SUMMARY OF THE INVENTION

The primary objective of the invention is to provide a rotor set which providing high efficiency low noise and less vibration.

In order to achieve the above objective, the invention provides a rotor set comprises a pair of engaging rotors disposed in a pump room of a housing rotating oppositely with identical speeds. Each rotor comprises a plurality of lobes, and each lobe has a fan-shaped end with a curved edge. The lobe generates an eccentric force to the rotor during the rotation to reduce mechanical consuming energy and save dynamic energy. Therefore, the rotors can achieve strong eccentric torque and self-vacuum effect with low dynamic energy.

The fan-shaped end of each lobe has a first blunt end and a second sharper end, and the first blunt end is the leading edge and the second sharper end is the trailing edge during the rotation.

An outer portion of the curved edge of each lobe is provided with a plurality of longitudinal slots.

Each lobe 41 of the rotors has a plurality of the balance positioning apertures. The balance positioning aperture is figured to accept a counter weight for balancing the weight of every lobe, which can eliminate the vibration and increase the efficiency of the rotor.

The shaft hole is provided with a pin slot on a sidewall corresponding to each lobe and configured to engage with the transmission shaft. Therefore, the moment from the transmission shaft is evenly distributed onto the rotor with a better efficiency

DETAILED DESCRIPTION OF THE INVENTION

Figure 1:
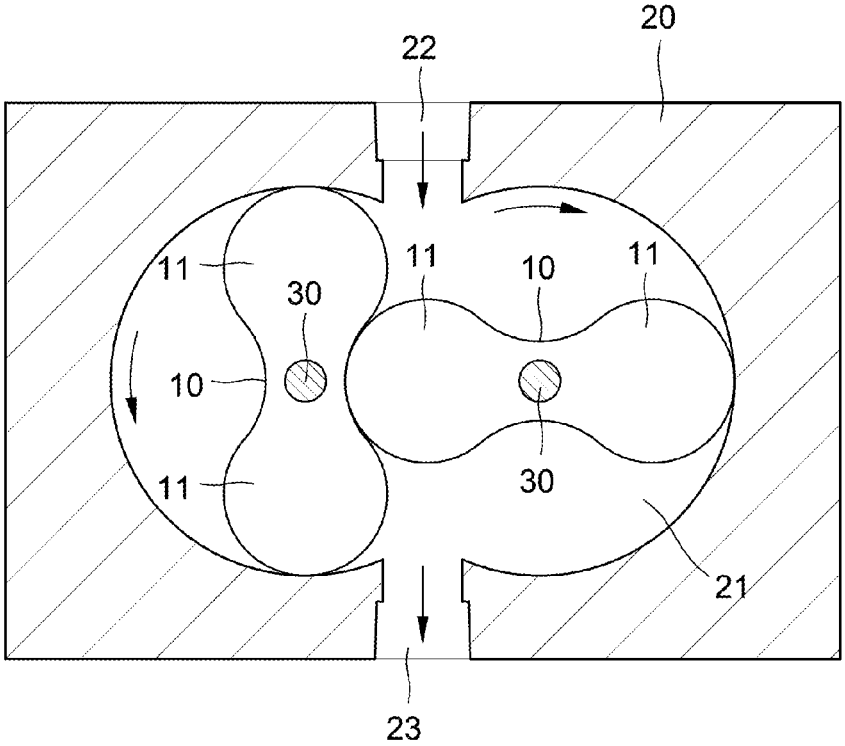
Fig. 1 Prior Art
FIG. 1 is a schematic drawing of a convenient roots rotor.
Figure 2:
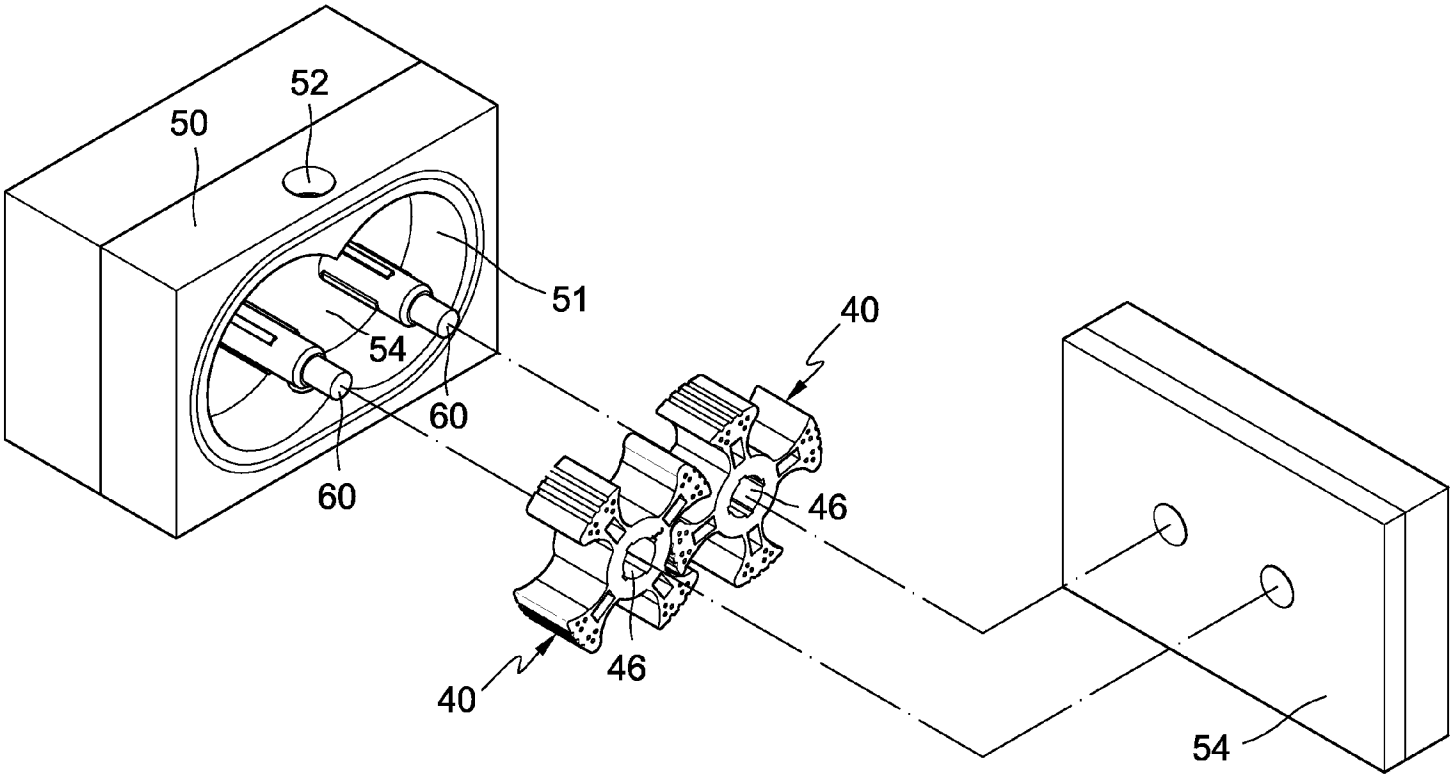
FIG. 2 is a perspective drawing of rotors and the housing of an embodiment of the present invention.
Figure 3:
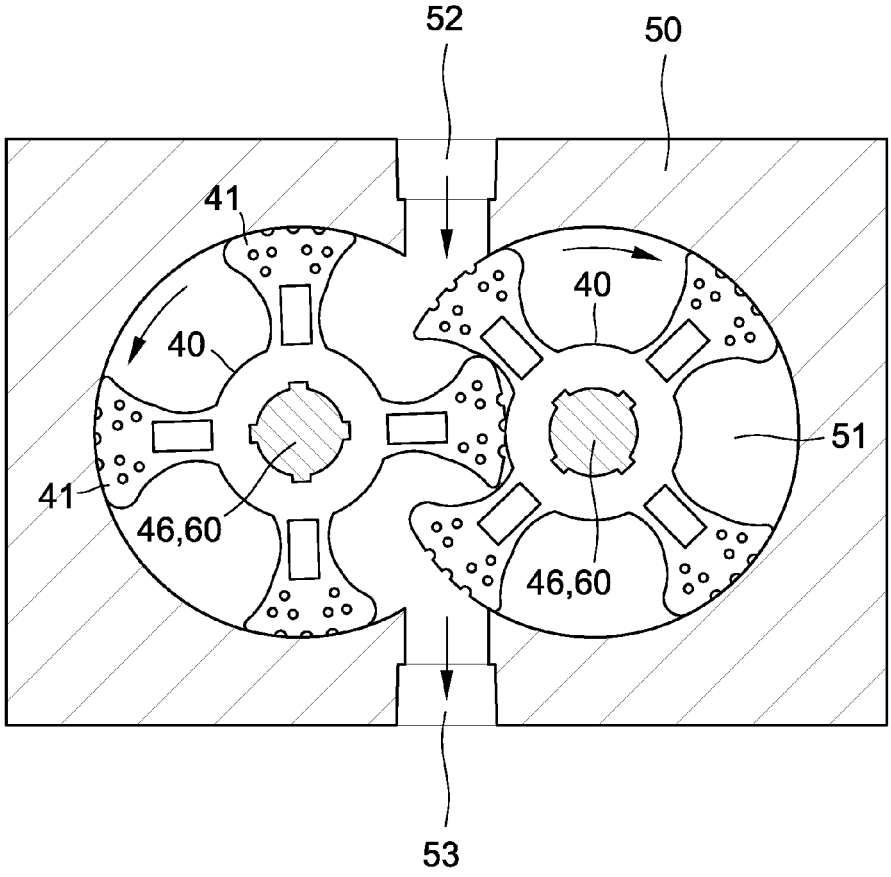
FIG. 3 is a cross-sectional schematic drawing of the embodiment of the rotor of the present invention.

As shown in FIG. 2 and FIG. 3, A rotor set structure comprises a pair of engaging rotors 40, the two rotors 40 are disposed in a pump room 51 provided inside of the housing 50. The pump room 51 has an inlet 52 at one side and an outlet 53 at another side. The rotor 40 is respectively connected to a transmission shaft 60, and the transmission shaft 60 drives the two rotors 40 in the pump room 51 to make rotation with equal speed in opposite directions.

The rotor 40 (please refer to FIG. 4 and FIG. 5 together) may have two lobes, three lobes, four lobes . . . etc., and not be limited to the shown four lobes. Each lobe 41 of the rotor 40 has a fan-shaped end with a curved edge, which generates an eccentric force to the rotor 40 during the rotation to reduce mechanical consuming energy and save dynamic energy. Therefore, the rotors 40 can achieve strong eccentric torque and self-vacuum effect with low dynamic energy.

Each lobe 41 of the rotors 40 (please refer to FIG. 4 and FIG. 5) has a first blunt end 411 and a second sharper end 412, and the first blunt end 411 is the leading edge and the second sharper end 412 is the trailing edge during the rotation.

Furthermore, each lobe 41 of the rotors 40 (please refer to FIG. 4 and FIG. 5) has an outer portion of the curved edge provided with a plurality of longitudinal slots 42, therefore, a contact area between the lobe 41 and the housing 50 during the rotation can be reduced to lower the friction consumption, mechanical consuming energy, noise, vibration.

Figure 4:
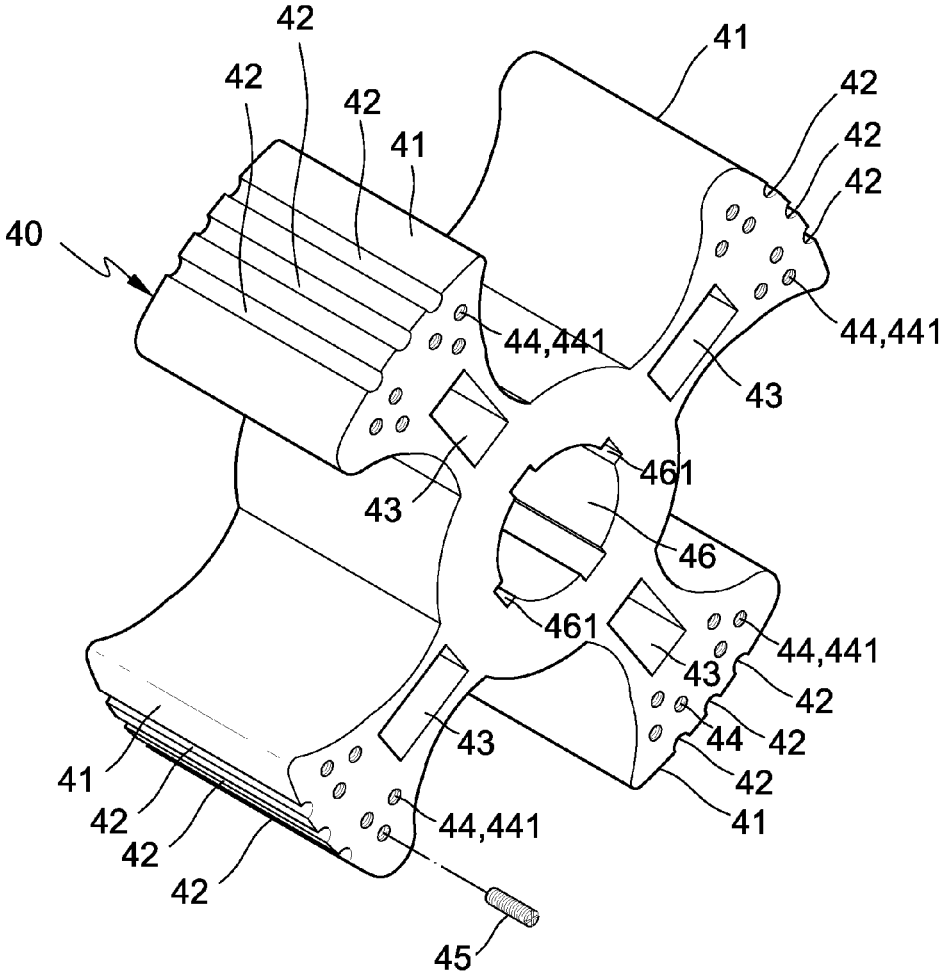
FIG. 4 is a perspective drawing of the rotor of the embodiment of the rotor of the present invention.
Figure 5:
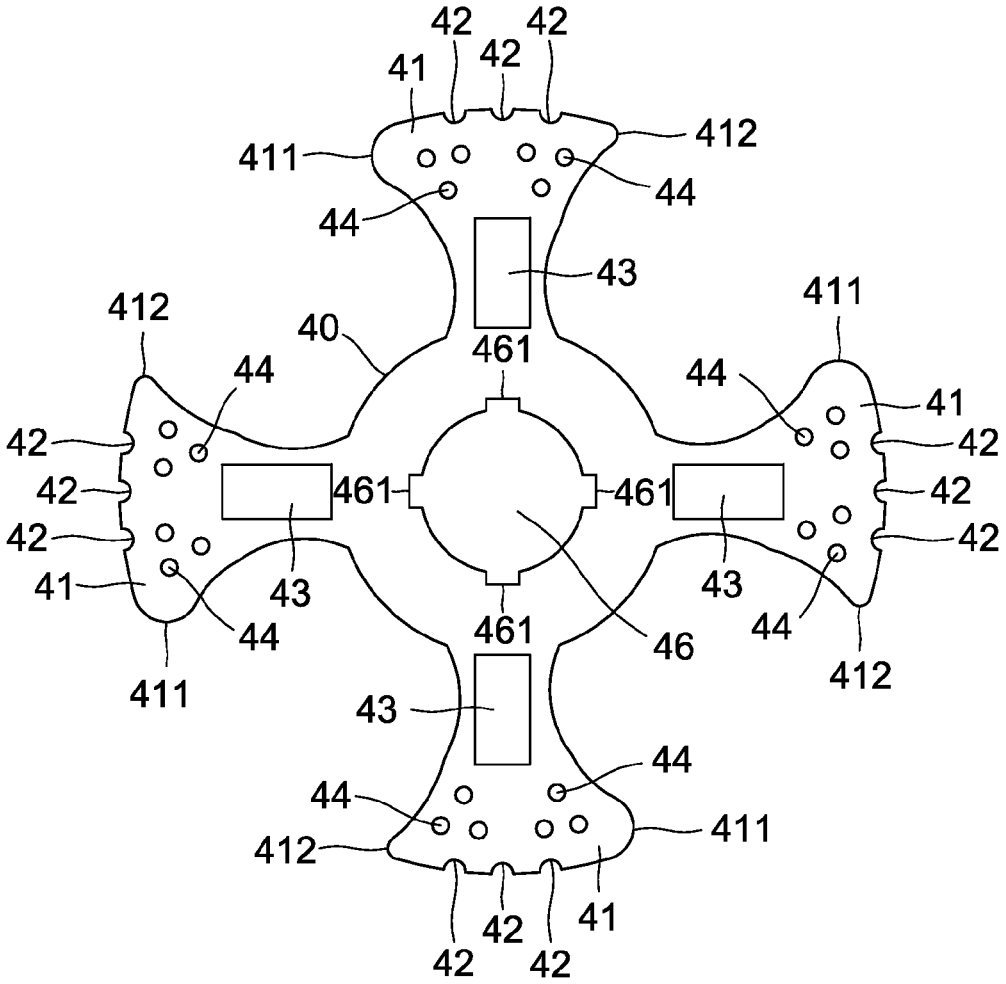
FIG. 5 is a panel drawing of the rotor of the embodiment of the rotor of the present invention.

Moreover, each lobe 41 of the rotors 40 (please refer to FIG. 4 and FIG. 5) has an indented opening 43 respectively disposed on two sides of a neck portion, contact area between the lobe 41 and two sidewalls 54 (as shown in FIG. 4) of the housing 50 during the rotation can be reduced to lower the friction consumption, mechanical consuming energy, noise, vibration.

In addition, each lobe 41 of the rotors 40 (please refer to FIG. 4 and FIG. 5) has a plurality of the balance positioning apertures 44. The balance positioning aperture 44 is figured to accept a counter weight 45 for balancing the weight of every lobe 41, which can eliminate the vibration and increase the efficiency of the rotor 40.

The balance positioning aperture 44 (please refer to FIG. 4 and FIG. 5) is provided with an inner thread 441, which can be used for securing the counter weight 45 into the balance positioning aperture 44.

In a preferred embodiment, the rotor 40 (please refer to FIG. 3, FIG. 4 and FIG. 5) is provided with a shaft hole 46 configured to engage with the transmission shaft 60. The shaft hole 46 is provided with a pin slot 461 on a sidewall corresponding to each lobe 41 and configured to engage with the transmission shaft 60. Therefore, the moment from the transmission shaft 60 is evenly distributed onto the rotor 40 with a better efficiency.

According to the above mention description, the rotor set provided in the embodiment of the present invention has following benefits:

(1). Since each lobe 41 of the rotor 40 has a fan-shaped end with a curved edge, which generates an eccentric force to the rotor 40 during the rotation to reduce mechanical consuming energy and save dynamic energy. Therefore, the rotors 40 can achieve strong eccentric torque and self-vacuum effect with low dynamic energy.

(2). Each lobe 41 has an outer portion of the curved edge provided with a plurality of longitudinal slots 42, therefore, a contact area between the lobe 41 and the housing 50 during the rotation can be reduced to lower the friction consumption, mechanical consuming energy, noise, vibration.

(3). Each lobe 41 has an indented opening 43 respectively disposed on two sides of a neck portion, contact area between the lobe 41 and two sidewalls 54 (as shown in FIG. 4) of the housing 50 during the rotation can be reduced to lower the friction consumption, mechanical consuming energy, noise, vibration.

(4). The shaft hole 46 is provided with a pin slot 461 on a sidewall corresponding to each lobe 41 and configured to engage with the transmission shaft 60. Therefore, the moment from the transmission shaft 60 is evenly distributed onto the rotor 40 with a better efficiency.

Although the invention has been described with reference to the foregoing preferred embodiment, it will be understood that the invention is not limited to the details thereof. Various equivalent variations and modifications can still occur to those skilled in this art in view of the teachings of the embodiment of the invention. Thus, all such variations and equivalent modifications are also embraced within the scope of the invention as defined in the appended claims.

What is claimed is:

1. A rotor set comprising:

a pair of engaging rotors disposed in a pump room of a housing rotating oppositely with identical speeds, each rotor comprising a plurality of lobes, each lobe having a fan-shaped end with a curved edge;

wherein each lobe has a plurality of balance positioning apertures, and each balance positioning aperture is provided with an inner thread.

2. The rotor set as claimed in claim 1, wherein the fan-shaped end of each lobe has a first blunt end and a second sharper end.

3. The rotor set as claimed in claim 1, wherein an outer portion of the curved edge of each lobe is provided with a plurality of longitudinal slots.

4. The rotor set as claimed in claim 1, wherein a shaft hole of each rotor is provided with a pin slot on a sidewall corresponding to each lobe and configured to engage with a transmission shaft.

* * * * *